US007820934B2

(12) United States Patent
Cardoletti et al.

(10) Patent No.: US 7,820,934 B2
(45) Date of Patent: Oct. 26, 2010

(54) METHOD FOR FIXING AN ELEMENT IN AN ELECTRICAL APPARATUS AND AN ELECTRICAL APPARATUS INCLUDING TWO PARTS FIXED ACCORDING TO SUCH A METHOD

(75) Inventors: Olivier Cardoletti, Voiron (FR); Hans Schellekens, La Terrasse (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 377 days.

(21) Appl. No.: 11/812,153

(22) Filed: Jun. 15, 2007

(65) Prior Publication Data

US 2008/0020631 A1 Jan. 24, 2008

(30) Foreign Application Priority Data

Jun. 30, 2006 (FR) ..... 06 05928

(51) Int. Cl.
*H01H 33/664* (2006.01)

(52) U.S. Cl. ..... 218/136; 218/123

(58) Field of Classification Search ..... 218/10, 218/118, 134–139, 123–128
See application file for complete search history.

(56) References Cited

U.S. PATENT DOCUMENTS 3,590,184 A * 6/1971 Wachta et al. ..... 218/136
4,440,995 A * 4/1984 Lange et al. ..... 218/122
5,495,085 A * 2/1996 Yorita et al. ..... 218/123
6,643,903 B2 * 11/2003 Stevenson et al. ..... 29/25.42

FOREIGN PATENT DOCUMENTS

| | | |
|---|---|---|
| DE | 39 332 159 | 4/1991 |
| EP | 1 172 834 | 1/2002 |
| JP | 01 033821 | 2/1989 |
| JP | 01 089126 | 4/1989 |
| JP | 04 065041 | 3/1992 |

* cited by examiner

*Primary Examiner*—Renee Luebke
*Assistant Examiner*—Marina Fishman
(74) *Attorney, Agent, or Firm*—Steptoe & Johnson LLP

(57) ABSTRACT

A method for fixing an element to a part of an electrical apparatus may include interposing an extender between the element and the part, where the extender is able to exert forces on the element and the part to position the element with respect to the part and/or to secure the element in position with respect to the part, by friction between one side of the extender and the element and between another side of the extender and the part, and to ensure positioning and/or securing of the element with respect to the part prior to final fixing, and to perform final fixing by performing two welding operations respectively between the element and the extender and between the extender and the part.

3 Claims, 4 Drawing Sheets

PRIOR ART

METHOD FOR FIXING AN ELEMENT IN AN ELECTRICAL APPARATUS AND AN ELECTRICAL APPARATUS INCLUDING TWO PARTS FIXED ACCORDING TO SUCH A METHOD

TECHNICAL FIELD

The object of the present invention is to provide a method for fixing an element on a part belonging to an electrical apparatus and an electrical apparatus such as a vacuum cartridge comprising at least two parts fixed according to such a method.

BACKGROUND

Vacuum cartridges are formed by an enclosure, in the majority of cases made of ceramic, of general cylindrical shape and closed by two end-plates inside which a stationary contact and a contact called movable contact are housed. This movable contact can be moved between a position in which the two stationary and movable contacts are touching one another so as to enable the current to flow and an open contact position in which these two contacts are separated so as to interrupt the current.

These cartridges can also comprise dielectric shields fitted around the contacts or fitted at the top and bottom parts of said cartridge.

Fixing of the dielectric shields on the enclosure, around the contacts, can be performed in several ways:

Cartridges formed by an enclosure made up of two cylindrical parts are for example known. The dielectric shield is formed by a cylindrical part comprising an annular rib extending perpendicularly to the axis of the cylinder and interposed between said cylindrical parts and the enclosure. The drawback of this solution lies in the bi-ceramic nature of the cartridge.

A cartridge called mono-ceramic is also known, comprising a monoblock enclosure the inside surface whereof presents a boss designed to cooperate with an annular recess provided on the outside surface of the shield. This solution presents the drawback of requiring machining of the enclosure.

A mono-ceramic cartridge is also known as described in the Patent U.S. Pat. No. 6,417,473 comprising a groove provided in the inside surface of the ceramic enclosure and designed to house a bungee spring which is secured vertically when inserted in the opening of the ceramic. In this embodiment, the dielectric shield is of cylindrical shape and comprises a cylindrical rib whereby the shield presses on the above-mentioned spring, welding being performed to fix the shield in definitive manner on the spring. The drawbacks of this embodiment lie mainly in the fact that the shield is not secured in rotation and that the ceramic enclosure requires machining.

Centering and welding of the respectively top and bottom dielectric shields require specific tooling and are performed at the time the cartridge is closed.

The contact pads are generally welded onto the electrodes before closing of the cartridge is performed, which means that the phases respectively of welding and of closing have to be performed in two separate steps.

SUMMARY

The present invention overcomes these drawbacks and proposes a method for fixing an element to a part belonging to an electrical apparatus and an electrical apparatus such as a vacuum cartridge comprising at least two parts fixed according to such a method, enabling centering and securing of the element which is to be fixed, prior to definitive fixing thereof, without requiring prior machining of the parts such as the ceramic enclosure, and enabling the apparatus to be assembled and fixing of the elements to be performed in a single step.

For this purpose, it is an object of the present invention to provide a method for fixing an element onto a part belonging to an electrical apparatus, this method being characterized in that it consists in interposing an extender between said element and said part, which extender is able to exert forces on the element and said part so as to position the element durably with respect to said part and/or to secure said element in position with respect to said part by friction between the extender and the element on the one hand and the extender and said part on the other hand, thus ensuring positioning and/or securing of said element with respect to said part.

According to a particular embodiment, this positioning and/or securing is performed prior to final fixing of said element.

According to a particular embodiment, the above-mentioned final fixing is achieved by performing two welding operations respectively between said element and the extender and between the extender and said part.

According to a particular embodiment of the invention, each welding operation comprises at least three welding points.

It is a further object of the present invention to provide an electrical apparatus such as a vacuum cartridge comprising at least one element designed to be fixed onto a part belonging to said apparatus by means of a method comprising the above-mentioned features taken either alone or in combination.

According to a particular feature, the vacuum cartridge comprising an enclosure of substantially cylindrical shape closed by two end cover-plates in which two arcing contacts and a dielectric shield fitted around the contacts are housed, this cartridge is characterized in that the above-mentioned shield is fixed onto the enclosure by means of an extender fitted inside the enclosure between said enclosure and the shield and able to exert radial forces on the enclosure and the shield, said extender being fixed respectively to the enclosure and to the shield by respectively two welding operations according to the above-mentioned method comprising the above-mentioned features taken either alone or in combination.

According to a particular feature, the vacuum cartridge comprising, at the top and/or bottom part thereof, an end cover-plate-plate and a dielectric shield fitted around the end cover-plate-plate, this cartridge is characterized in that it comprises an extender fitted between the above-mentioned end cover-plate and the dielectric shield and fixed by welding on the one hand to said cover-plate and on the other hand to said shield, according to the above-mentioned method comprising the above-mentioned features taken either alone or in combination.

According to a particular feature, the vacuum cartridge comprising an enclosure of substantially cylindrical shape closed by two end cover-plates in which two arcing contacts are housed, said cartridge comprising at the top and/or bottom part thereof a dielectric shield fitted around the enclosure, this cartridge is characterized in that it comprises an extender fitted between said shield and the enclosure and fixed by welding on the one hand to said enclosure and on the other hand to said shield, according to the above-mentioned method comprising the above-mentioned features taken either alone or in combination.

According to another feature, at least one of the respectively stationary and movable contacts is fixed to the electrode that is associated therewith by means of an extender interposed between the contact and the electrode.

According to another feature, the or each contact comprises a tubular aperture designed to receive a part of conjugate shape of the corresponding electrode.

According to another feature, the or each contact comprises a tubular aperture designed to receive a part of conjugate shape of the corresponding electrode, and said extender presents a disk shape comprising a closed tubular duct in the center thereof, which duct is designed to be inserted in the tubular duct of the corresponding contact and to receive the tubular part of corresponding shape belonging to the electrode.

According to another feature, said vacuum cartridge comprising a bellow protection shield fitted around a bellow fitted around the movable electrode, this cartridge is characterized in that the bellow protection shield is fixed to the electrode by means of an extender fitted between the bellow protection shield and the electrode and secured respectively by two welds onto the electrode and onto the bellow protection shield.

But other advantages and features of the invention will become more clearly apparent from the following description which refers to the accompanying drawings given for example purposes only.

DETAILED DESCRIPTION

Figure 1:
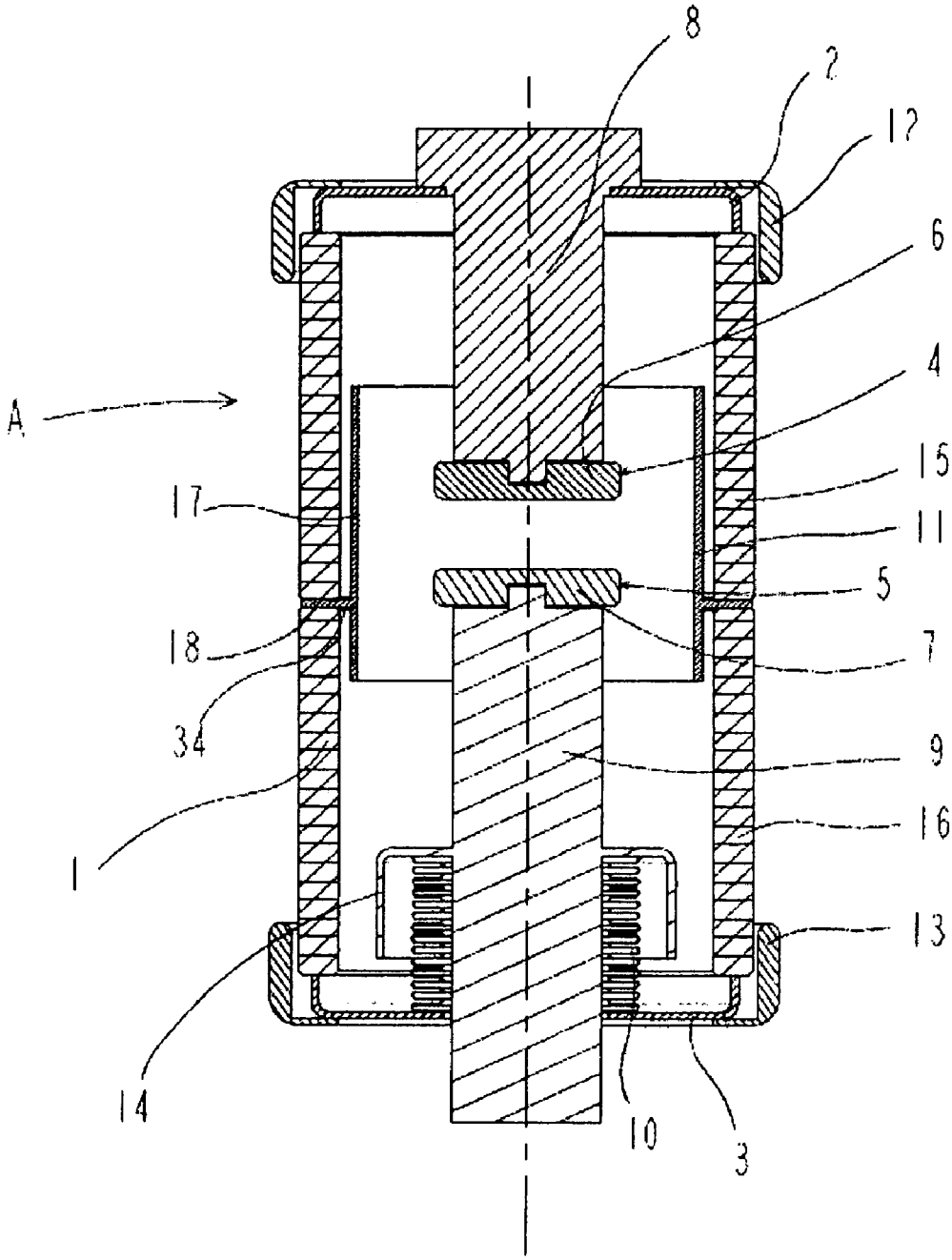
FIG. 1 is a longitudinal cross-sectional view of a vacuum cartridge according to the prior art.
Figure 2:
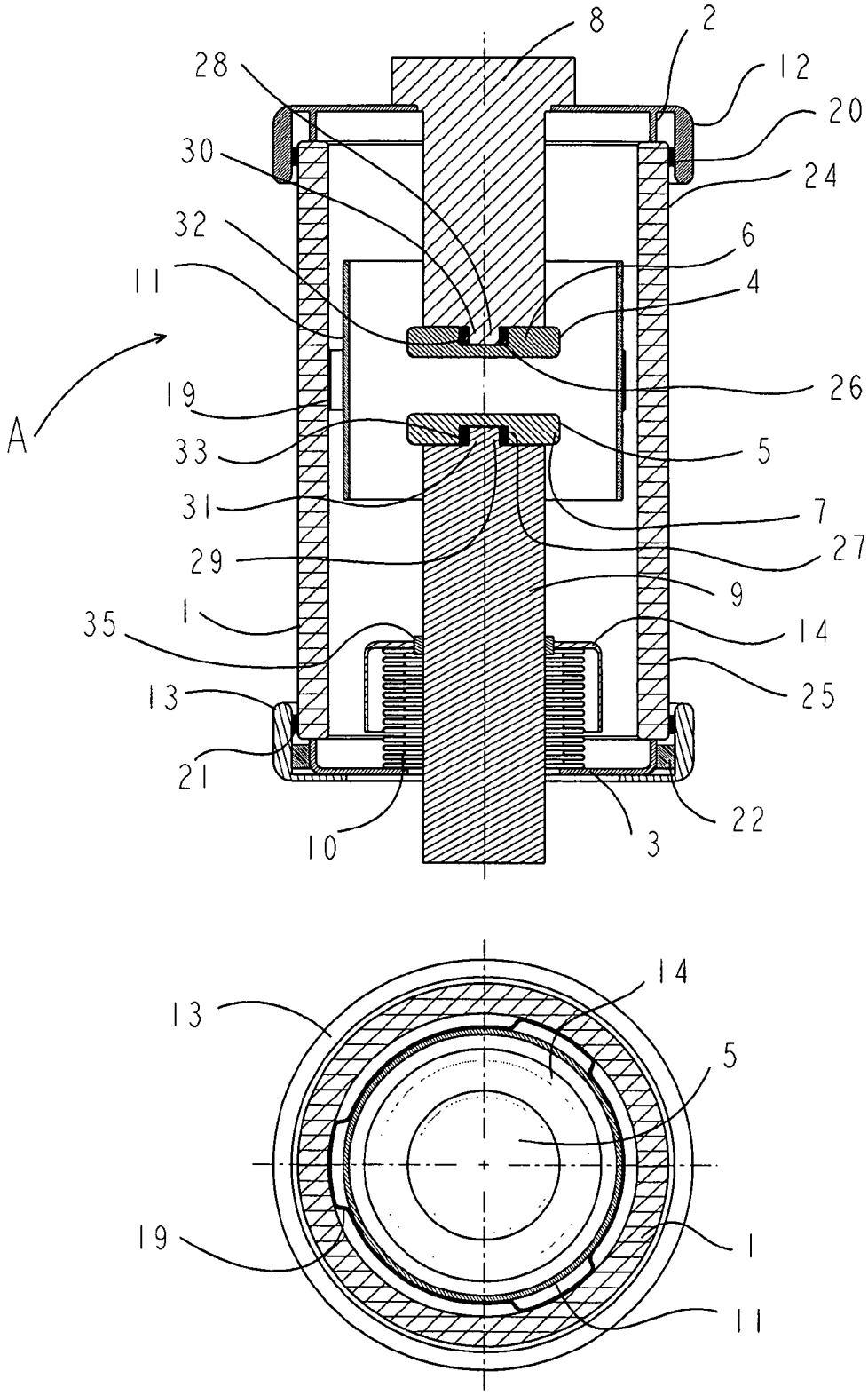
FIG. 2 is an identical view of a vacuum cartridge according to the invention.

In FIGS. 1 and 2 a vacuum cartridge A is represented designed to be used in a switch to perform breaking in an electric circuit. This cartridge A comprises a cylindrical enclosure 1 close off by two end cover-plates 2,3, in which two arcing contacts 4,5 are housed, one contact whereof, the stationary contact 4, is securedly fixed to one 2 of the above-mentioned cover-plates 2,3, whereas the other contact whereof, the movable contact 5, is fitted with axial sliding inside the cartridge A through the end cover-plate called the bottom cover-plate 3. Each contact 4,5 comprises a contact 6,7 pad fixed on an electrode 8,9, the electrode 8 of the stationary contact 4 being fixed to the end cover-plate called the top cover-plate 2, whereas the electrode 9 of the movable contact 5 is fitted sliding through the end cover-plate 3 called the bottom cover-plate, a bellows seal 10 being fitted between the movable electrode 9 and the bottom end cover-plate 3. This cartridge A also comprises dielectric shields 11,12,13 and 14 comprising a shield 11 placed around the contacts 4,5, a shield 12 placed around the end cover-plate 2 called the top cover-plate and a shield 13 situated around the end cover-plate 3 called the bottom cover-plate, and a shield 14 situated around the bellows seal 10. The shield 14 is fixed to the electrode 9 by means of an extender 35 fitted between shield 14 and the electrode 9 and secured respectively by two welds onto the electrode 9 and the shield 14.

According to the prior art embodiment represented in FIG. 1, the enclosure 1 of the cartridge A is made up of two parts 15,16. The dielectric shield 11 situated around the contacts 4,5 is formed by a cylindrical part 17 and comprises a flange ring 18 extending from the cylindrical part 17 of the shield 11 in a direction perpendicular to the axis of the shield. Fixing of said shield 11 on the enclosure 1 is performed by placing the flange ring 18 between the two enclosure parts 15,16 and making a weld 34 between the shield 11 and the enclosure 1 on each side of the flange ring 18.

The two shields 12,13 respectively the top and bottom shield, are centered and welded with a tool when closing of the cartridge is performed.

The two contact pads 6,7 are welded onto the stationary and movable electrodes 8,9 before closing of the cartridge is performed.

In FIG. 2, the main shield 11 is fixed to the enclosure 1 according to the invention by means of an extender 19, the two dielectric shields 12,13 respectively the top and bottom shield are likewise fixed to the enclosure 1 by means of an extender 20,21, and the bottom dielectric shield 13 is also fixed to the bottom end cover-plate 3 by means of an extender 22.

Assembly and fitting of the main shield 11 according to the invention will be described in the following with reference to FIGS. 3 to 12.

Figure 3:
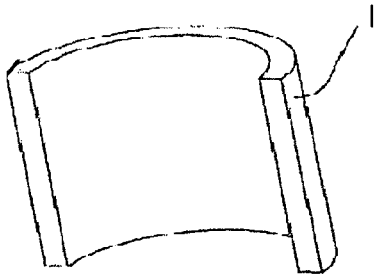
FIG. 3 is a partial perspective view of a ceramic enclosure belonging to a cartridge according to the invention.
Figure 7:
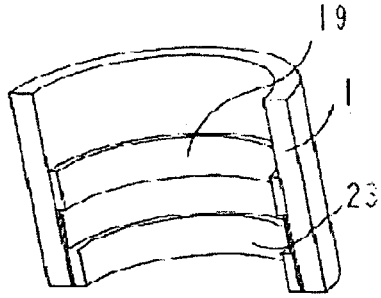
FIGS. 7 and 8 are identical views to FIGS. 5 and 6 after the extender has been fitted.
Figure 4:
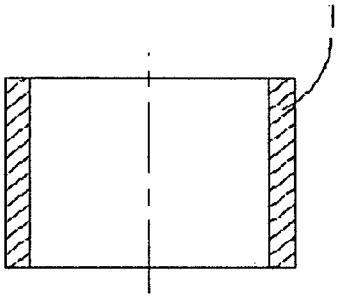
FIG. 4 is an axial cross-sectional view of said enclosure.
Figure 8:
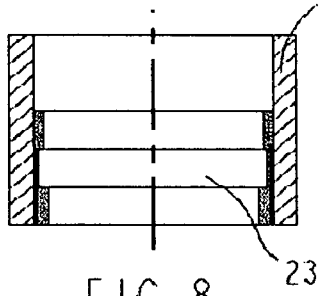
Figure 5:
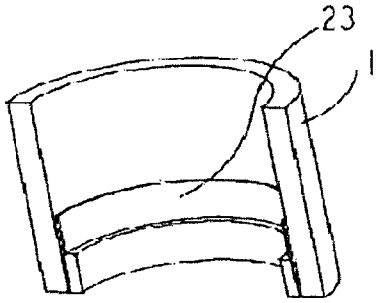
FIGS. 5 and 6 are identical views to the previous ones, after an assembly tool has been fitted in place.
Figure 9:
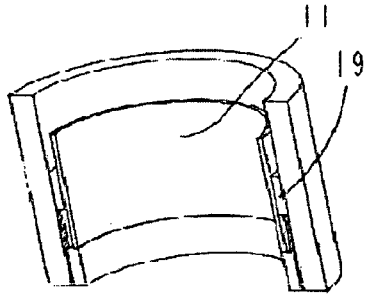
FIGS. 9 and 10 are identical views to FIGS. 7 and 8 after the shield has been fitted.
Figure 6:
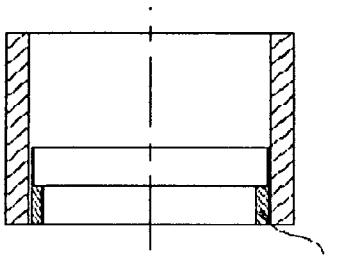
Figure 10:
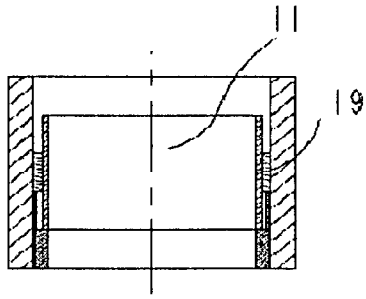
Figure 11:
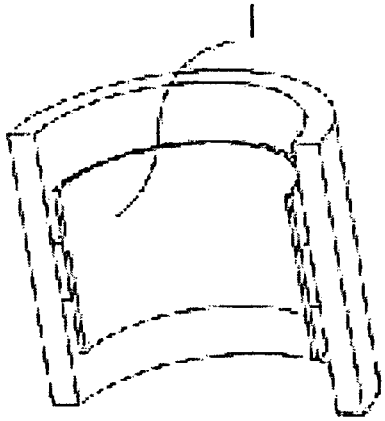
FIGS. 11 and 12 are identical views to FIGS. 9 and 10 after the assembly tool has been removed.
Figure 12:
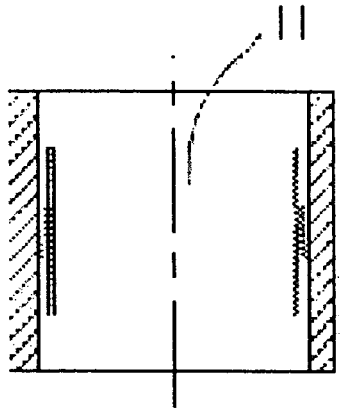
Figure 13:
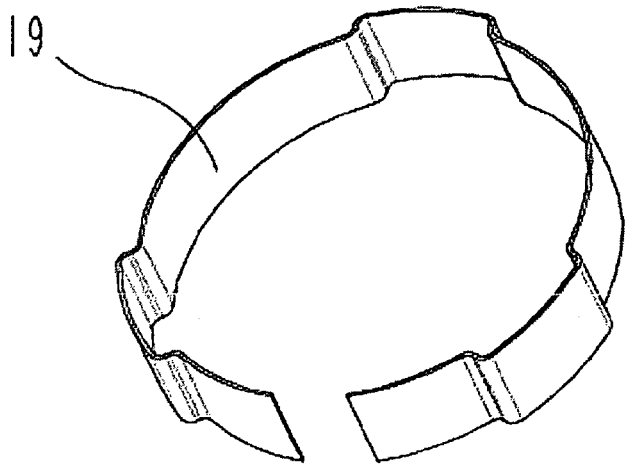
FIG. 13 is a perspective view of an extender.

In FIGS. 3 and 4, the shield has not yet been fixed to the enclosure 1. In FIGS. 5 and 6, a fitting tool 23 is placed inside the enclosure 1 to guide fitting of the extender. In FIGS. 7 and 8, the extender 19 is placed inside the enclosure 1 and is pressing on the fitting tool 23. In FIGS. 9 and 10, the shield 11 is placed inside the extender 19 and said extender 19 generates radial forces on the shield 11 and the enclosure so as to keep said shield 11 in position, before final fixing thereof, which is achieved by two welds made respectively between the shield 11 and the extender 19 and between the extender 19 and the enclosure 1. The montage fitting tool is then removed (FIGS. 11 and 12).

Fixing of the top 12 and bottom 13 shields (or deflectors) is performed by placing two extenders 20,21 respectively around the top part 24 and the bottom part 25 of the enclosure 1, and then an extender 22 around the bottom end cover-plate 3, and in then placing the top dielectric shield 12 around the extender 20 situated at the top part 24 of the enclosure 1; then the bottom dielectric shield 13 is fitted around the two extenders 21,22 situated at the bottom part 25 of the enclosure 1. Final fixing of the extenders 19 to 22 will be performed by welding on the one hand between the extenders 19 to 22 and the corresponding dielectric shields 11,12,13 and on the other hand between the extenders 19,20,21 and the ceramic enclosure 1, or between the extender 22 and the bottom end cover-plate 3. The extenders 19 to 22 then perform centering of the dielectric shields 11,12,13.

At the level of the contacts 4,5, extenders 26,27 are placed respectively between the contact pads 6,7 and their respective electrode 8,9. The contacts 4,5 comprise a tubular aperture 28,29 designed to receive a part of conjugate shape 30,31 of the corresponding electrode 8,9, and the extender 26,27 associated with the contact respectively 4,5 presents a disk-shape comprising, in the center thereof, a closed tubular duct 32,33 designed to receive the tubular part of corresponding shape 30,31 belonging to the electrode 8,9. The extenders 26,27 placed at the level of the contacts 4,5 thus perform securing of the contact pads 6,7 on the corresponding electrodes 8,9 prior to final fixing of said pads 6,7 to the electrodes 8,9.

All the above-mentioned welds are made at the same time after the cartridge has been assembled and placed inside a furnace.

It can therefore be observed that according to the invention, fixing of the shield can be performed with a smooth ceramic without any machining having to be performed thereon. But it should be noted that the invention can also be implemented on a non-smooth ceramic. The spring blocks the shield in position by friction, vertically and in rotation, prior to final fixing by welding. This method of fixing makes it possible to adapt to a wide range of ceramics manufacturing tolerances.

It can be noted that other elements than those described above will be able to be fixed inside the enclosure, such as the bellows protection shield on the electrode or centering tooling on the outside which can act as a three-point protection shield.

The invention is naturally not limited to the embodiments that have been described and illustrated which have been given for example purposes only.

On the contrary, the invention extends to encompass all the technical equivalents of the means described as well as combinations thereof if the latter are performed according to the spirit of the invention.

The invention claimed is:

1. A vacuum cartridge, comprising an enclosure of substantially cylindrical shape closed by first and second end cover-plates and housing two arcing contacts and first and second dielectric shields respectively fitted around the first and second end cover-plates, the cartridge further comprising a first extender fitted between the first end cover-plate and the first dielectric shield, and a first side of the first extender welded to said first end cover-plate and a second side of the first extender welded to said first dielectric shield, wherein at least one of the contacts is movable, and fixed to a movable electrode by a third extender fitted between the movable contact and the movable electrode;

wherein the first dielectric shield is fitted around the enclosure, and the cartridge further comprises a second extender fitted between said first dielectric shield and the enclosure, a first side of the second extender welded to said enclosure, and a second side of the second extender welded to said first dielectric shield;

wherein each contact comprises a tubular recess, and the tubular recess is of a shape complementary to a shape of a corresponding electrode, and the third extender is of a disk shape with a closed tubular duct in a center thereof, which tubular duct is insertable into a tubular recess of a corresponding contact and for receiving a complementary part of an electrode, the third extender for securing a contact to an electrode.

2. A vacuum cartridge according to claim 1, further comprising a bellows around the movable electrode, a bellow protection shield fitted around the bellows, the bellow protection shield being fixed to said movable electrode by a fourth extender fitted between the bellow protection shield and the movable electrode and fixedly welded to the electrode and to the bellow protection shield.

3. A vacuum cartridge according to claim 1, further comprising a third dielectric shield fitted around the contacts, wherein the third dielectric shield is fixed to the enclosure by a fifth extender fitted inside the enclosure between said enclosure and the third dielectric shield, and for exerting radial forces on the enclosure and the third dielectric shield to position and/or to secure the third dielectric shield with respect to said enclosure, said fifth extender being fixedly welded to the enclosure and to the third dielectric shield.

* * * * *